United States Patent [19]

Oustad

[11] Patent Number: 4,480,757

[45] Date of Patent: Nov. 6, 1984

[54] COLLAPSIBLE FRAME SUPPORT FOR PIVOTAL BOOM ON A PORTABLE CRANE

[75] Inventor: Maynard A. Oustad, Duluth, Minn.

[73] Assignee: AMCA International Corporation, Hanover, N.H.

[21] Appl. No.: 343,717

[22] Filed: Jan. 28, 1982

[51] Int. Cl.[3] ..... B66C 7/00; B66C 23/42; B66C 23/52; B63B 35/30

[52] U.S. Cl. ..... 212/257; 212/186; 212/190; 212/191; 212/192; 212/198; 212/206; 212/224; 212/225; 414/138; 414/143

[58] Field of Search ..... 212/175, 177, 178–179, 212/181, 188, 183, 185, 187, 190–198, 205–206, 211, 218, 223–225, 227, 231–233, 237–241, 255, 257, 260–268, 265; 414/138, 143

[56] References Cited

U.S. PATENT DOCUMENTS

| | | | |
|---|---|---|---|
| 219,691 | 9/1979 | Coudoint-Gougeul . | |
| 654,739 | 7/1900 | Lancaster . | |
| 734,974 | 7/1903 | Shoosmith . | |
| 763,222 | 6/1904 | Driessche | 212/227 |
| 859,031 | 7/1907 | Abel . | |
| 1,047,233 | 12/1912 | Jackson | 212/190 |
| 1,079,519 | 11/1913 | Sawyer | 212/187 |
| 1,193,587 | 8/1916 | Miller . | |
| 1,343,630 | 6/1920 | Locarni . | |
| 1,428,809 | 9/1922 | Zimmerman . | |
| 1,507,598 | 9/1924 | Gustafson . | |
| 2,143,111 | 1/1939 | Hayes | 212/225 |
| 2,226,361 | 12/1940 | Taylor | 212/227 |
| 2,361,331 | 10/1944 | Taylor | 212/227 |
| 2,366,574 | 1/1945 | Taylor | 212/262 |
| 2,370,661 | 3/1945 | Hayes | 212/227 |
| 2,374,074 | 4/1945 | Berby et al. | 212/192 |
| 2,522,466 | 9/1950 | Schneider | 414/143 |
| 2,667,275 | 1/1954 | Llanusa . | |
| 2,738,884 | 3/1956 | Callouette et al. | 212/186 |
| 2,772,411 | 10/1957 | Cooper . | |
| 2,796,178 | 6/1957 | Praschak . | |
| 2,972,199 | 2/1961 | Leaimont | 212/262 |
| 3,143,224 | 8/1964 | Campbell et al. | 414/143 |
| 3,190,475 | 6/1965 | Fischer . | |
| 3,240,353 | 3/1966 | Leavesley . | |
| 3,244,297 | 4/1966 | Kinkopf | 212/190 |
| 3,339,707 | 9/1967 | Ludwig | 212/262 |
| 3,402,824 | 7/1968 | Zweifel . | |
| 3,467,263 | 9/1969 | Auzins et al. | 212/190 |
| 3,642,148 | 2/1972 | Durrand . | |
| 3,722,705 | 3/1973 | Gould . | |
| 3,752,326 | 8/1973 | Levingston . | |
| 3,804,264 | 4/1974 | Hedeen, Jr. et al. | 212/191 |
| 3,834,552 | 9/1974 | Loffink . | |
| 3,851,767 | 12/1974 | Durand . | |
| 3,945,508 | 3/1976 | Colin . | |
| 3,957,161 | 5/1976 | Tax . | |
| 3,957,165 | 5/1976 | Smith . | |
| 4,039,086 | 8/1977 | Ray . | |
| 4,067,446 | 1/1978 | Ray . | |
| 4,074,817 | 2/1978 | Ray . | |
| 4,074,818 | 2/1978 | Ray . | |
| 4,113,112 | 9/1978 | Ray | 212/71 |
| 4,220,246 | 9/1980 | Ray . | |
| 4,297,961 | 11/1981 | Johnson, Jr. | 212/ |
| 4,303,166 | 12/1981 | Campbell et al. | 212/227 |
| 4,363,413 | 12/1982 | Gyomrey | 212/262 |

FOREIGN PATENT DOCUMENTS

| | | | |
|---|---|---|---|
| 738822 | 7/1966 | Canada | 414/143 |
| 23894 | 10/1911 | United Kingdom | 212/190 |
| 339191 | 7/1921 | Fed. Rep. of Germany | 212/239 |
| 547300 | 3/1932 | Fed. Rep. of Germany | 212/262 |
| 800774 | 12/1950 | Fed. Rep. of Germany | 212/190 |
| 169627 | 5/1951 | Fed. Rep. of Germany . | |

(List continued on next page.)

*Primary Examiner*—Sherman D. Basinger
*Assistant Examiner*—R. B. Johnson
*Attorney, Agent, or Firm*—Harness, Dickey & Pierce

[57] ABSTRACT

A crane structure mounted on a transport vehicle, preferably a marine vessel, is disclosed. The crane structure includes a gantry structure mounted on a vertical tower structure and having boom portions protruding from the tower structure. Preferably, the boom portions may be pivotally lowered from their operating positions and the tower structure may be rotated in a horizontal plane, thereby reducing the overall dimensions of the crane structure to allow transport under overhead obstructions and through narrow passageways.

2 Claims, 13 Drawing Figures

FOREIGN PATENT DOCUMENTS

| | | | |
|---|---|---|---|
| 925488 | 3/1955 | Fed. Rep. of Germany | 212/190 |
| 1203437 | 10/1965 | Fed. Rep. of Germany | 212/227 |
| 1268339 | 5/1968 | Fed. Rep. of Germany . | |
| 1811103 | 6/1969 | Fed. Rep. of Germany | 212/190 |
| 1905257 | 8/1970 | Fed. Rep. of Germany . | |
| 1949456 | 4/1971 | Fed. Rep. of Germany . | |
| 682029 | 5/1930 | France . | |
| 1212461 | 3/1960 | France . | |
| 1323411 | 7/1963 | France . | |
| 1384598 | 11/1964 | France | 212/233 |
| 496772 | 8/1954 | Italy . | |
| 42917 | 7/1916 | Sweden . | |
| 185826 | 10/1963 | Sweden | 212/227 |
| 12734 | 2/1850 | United Kingdom . | |
| 19166 | 8/1894 | United Kingdom . | |
| 695358 | 8/1953 | United Kingdom | 212/190 |
| 697810 | 9/1953 | United Kingdom | 212/191 |
| 752129 | 7/1956 | United Kingdom | 212/191 |
| 1286829 | 8/1972 | United Kingdom | 212/239 |
| 1414354 | 11/1975 | United Kingdom | 212/190 |
| 396303 | 1/1974 | U.S.S.R. . | |

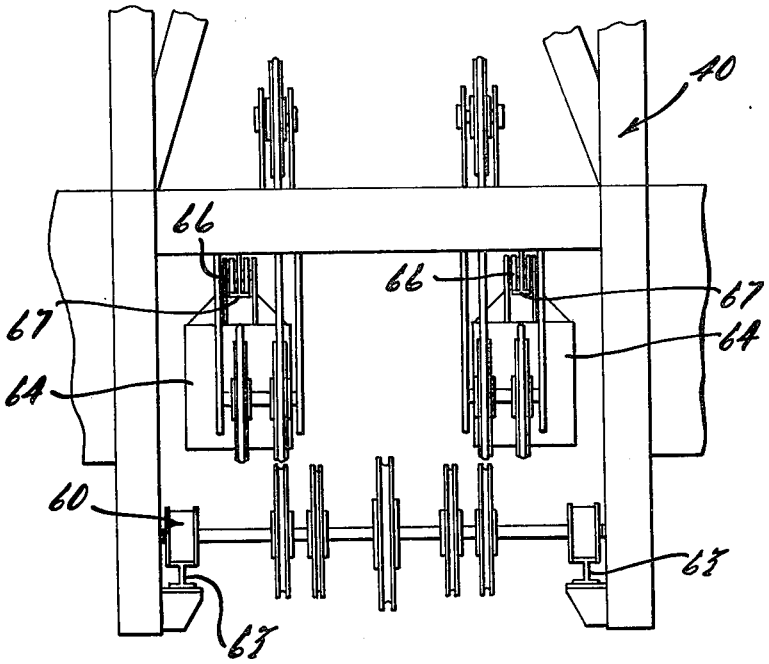
FIG. 5.
FIG. 6.
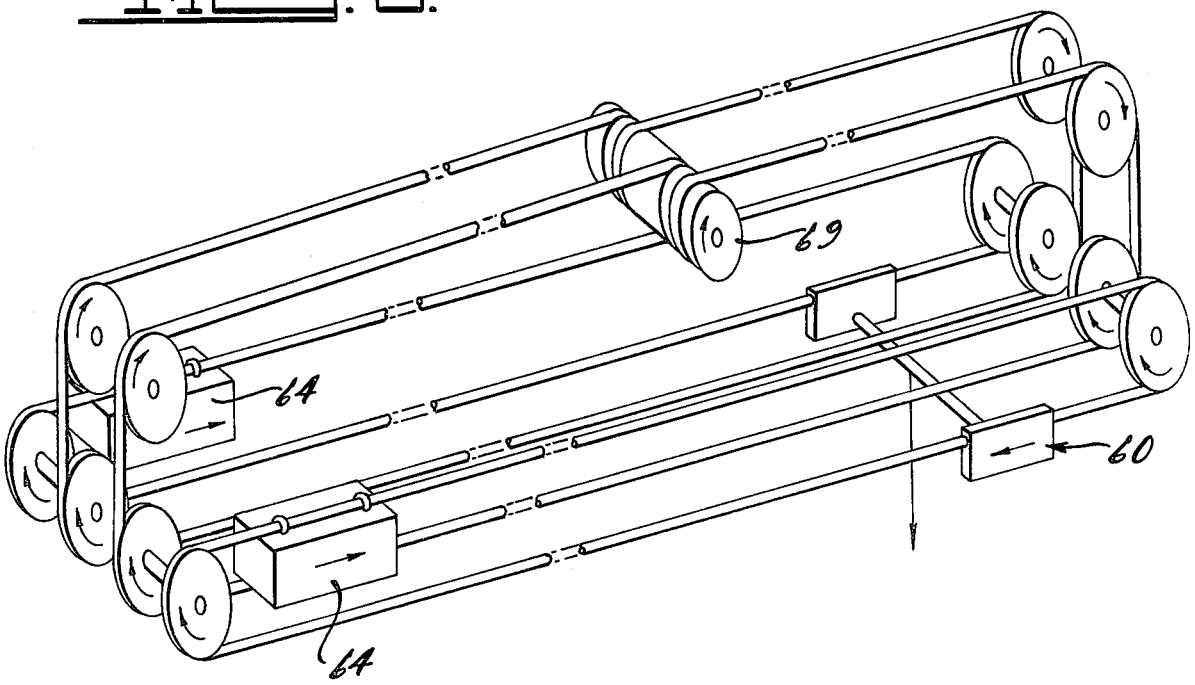

COLLAPSIBLE FRAME SUPPORT FOR PIVOTAL BOOM ON A PORTABLE CRANE

BACKGROUND AND SUMMARY OF THE INVENTION

The invention relates to a crane structure for loading and unloading cargo or other items onto or from a ship or other cargo-carrying vehicle. More particularly, the invention relates to such a crane structure which is itself mounted on a transport vehicle and includes a movable horizontal boom or gantry structure and apparatus and mechanism for allowing the gantry structure to be altered for transport. In particular, the crane structure can be rotated so that the gantry structure is in a position parallel to the direction of travel of the transport vehicle and the overall height and width of the crane structure can be reduced to allow travel of the entire transport structure under bridges or through narrow passageways.

It is frequently desirable or necessary to load or unload a large ocean going transport ship so that the cargo (e.g. bulk goods) can be transported through shallow rivers and other waterways by barges and the like. It is also desirable at times to load or unload the transport ship at an off-shore position away from stationary docking facilities. Accordingly, large gantry-type cranes have been mounted on tower structures attached to floating barges so that the cranes may be moved into positions adjacent such ships thus allowing cargo or other items to be loaded or unloaded between the ships and separate cargo barges. Such prior crane structures, however, have suffered the disadvantages of being insufficient in either overall height or trolley travel to clear or efficiently load or unload the very large ships now commonly in use. Alternatively, if such crane structures are built with sufficient height, trolley travel and size to be usable with such ships, they are frequently limited to use in a specific locality because of the inability to be transported under bridges or through relatively narrow waterways. The need has thus arisen for such a large crane structure that is equipped with apparatus for selectively decreasing the overall height and the overall width dimension perpendicular to the direction of travel.

In accordance with the present invention, a gantry-type crane structure is attached to the top of a vertical tower structure which is mounted on a transport vehicle, preferably a floating barge or other vessel. The boom portions are also preferably supported or anchored by an upper supporting structure attached to the top of the tower structure. The tower structure is adapted for rotation on the transport between a first position wherein the outer boom portions of the gantry protrude outwardly in horizontal directions perpendicular to the direction of travel of the vessel and a second position wherein the boom portions are aligned with the direction of travel of the vessel. In addition to such rotational capability, the preferred tower structure is adapted for linear travel along the transport vehicle and includes self-contained operating apparatus. The crane structure is also preferably equipped with means for lowering the outwardly-protruding boom portions as well as for lowering or collapsing the upper supporting structure on the top of the tower structure. Thus, the overall height and width of the crane may be significantly reduced in order to allow sufficient clearance under bridges or other overhead obstructions and through narrow passageways.

BRIEF DESCRIPTION OF THE DRAWINGS

FIG. 5 is a detailed end view of the bucket and counterweight trolleys and their associated tracks of the crane structure;

FIG. 6 is a schematic view illustrating the operational relationship between the bucket trolley and the counterweight trolleys;

DETAILED DESCRIPTION OF THE PREFERRED EMBODIMENTS

Figure 1:
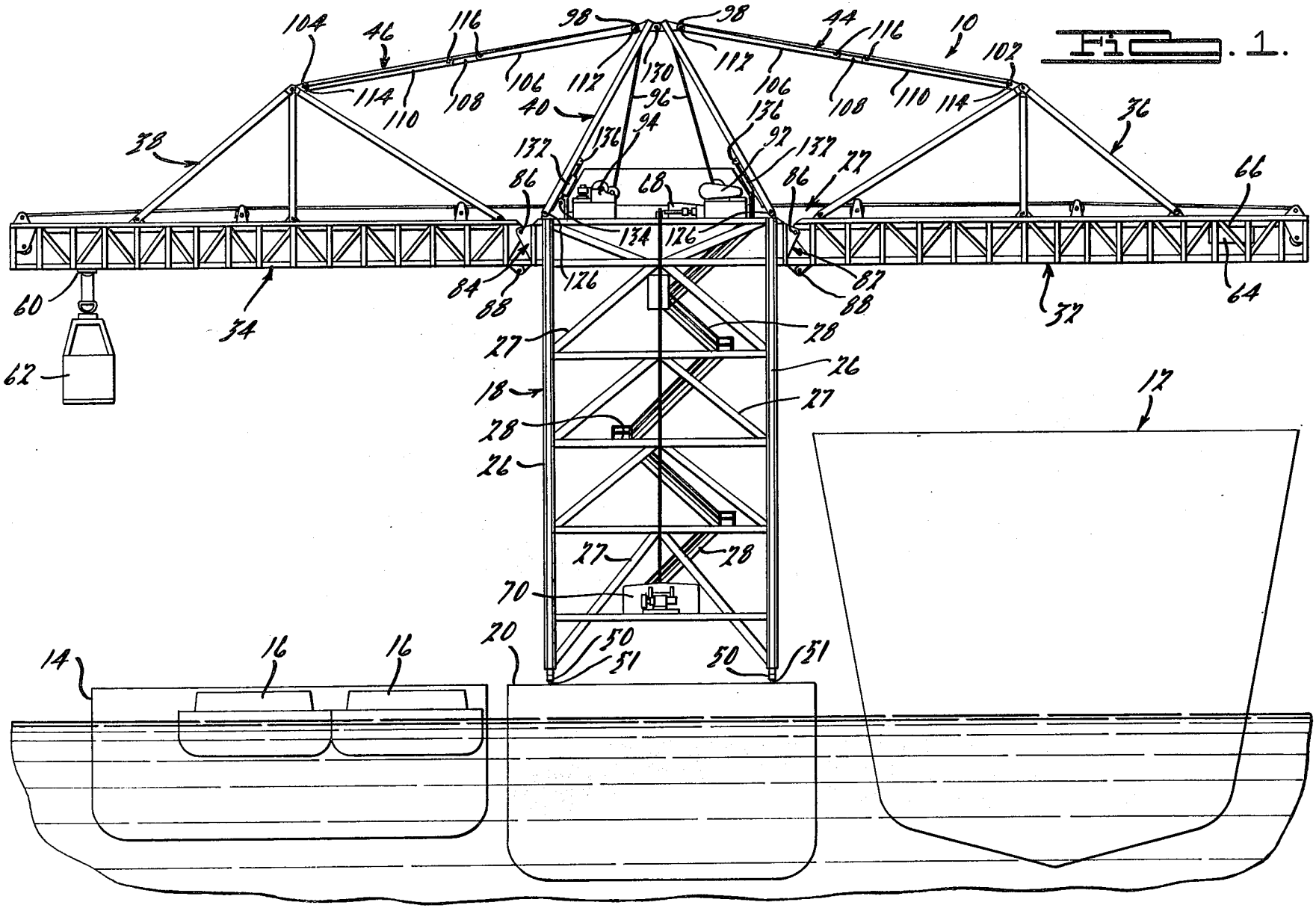
FIG. 1 is an elevational view of a crane embodying the present invention, illustrating the crane in position for loading or unloading operations between a large ship and one or more cargo barges.

FIGS. 1 through 13 illustrated a crane structure 10 embodying the present invention situated between a cargo ship 12 and a cargo barge 14 for purposes of loading or unloading a number of cargo items therebetween. As shown, it is possible to load or unload a single large barge 14 or a plurality of smaller barges 16. The crane structure of the present invention is particularly useful for loading bulk cargo, such as coal, from barges onto ocean-going transport vessels for shipment to other ports around the world. The particular crane structure 10 is shown in the drawings for purposes of illustration only. One skilled in the art will readily recognize from the following discussion that variations to the crane structure 10 may be made without departing from the spirit and scope of the invention and further that the invention is not limited to crane structures mounted on marine-type transport vehicles.

The crane structure 10 includes a vertical tower structure 18 mounted on a floating barge or other vessel 20. A horizontal boom or gantry structure 22 is secured to the upper end of the tower structure 18 and includes a pair of boom portions 32 and 34 protruding outwardly in opposite directions. When the crane structure 10 is used to transport cargo from one vessel to another the gantry or boom structure 22 is positioned substantially perpendicular to the length of the barge 20 and thus perpendicular to the vessels and barges 12 and 14 being loaded and unloaded.

Figure 4:
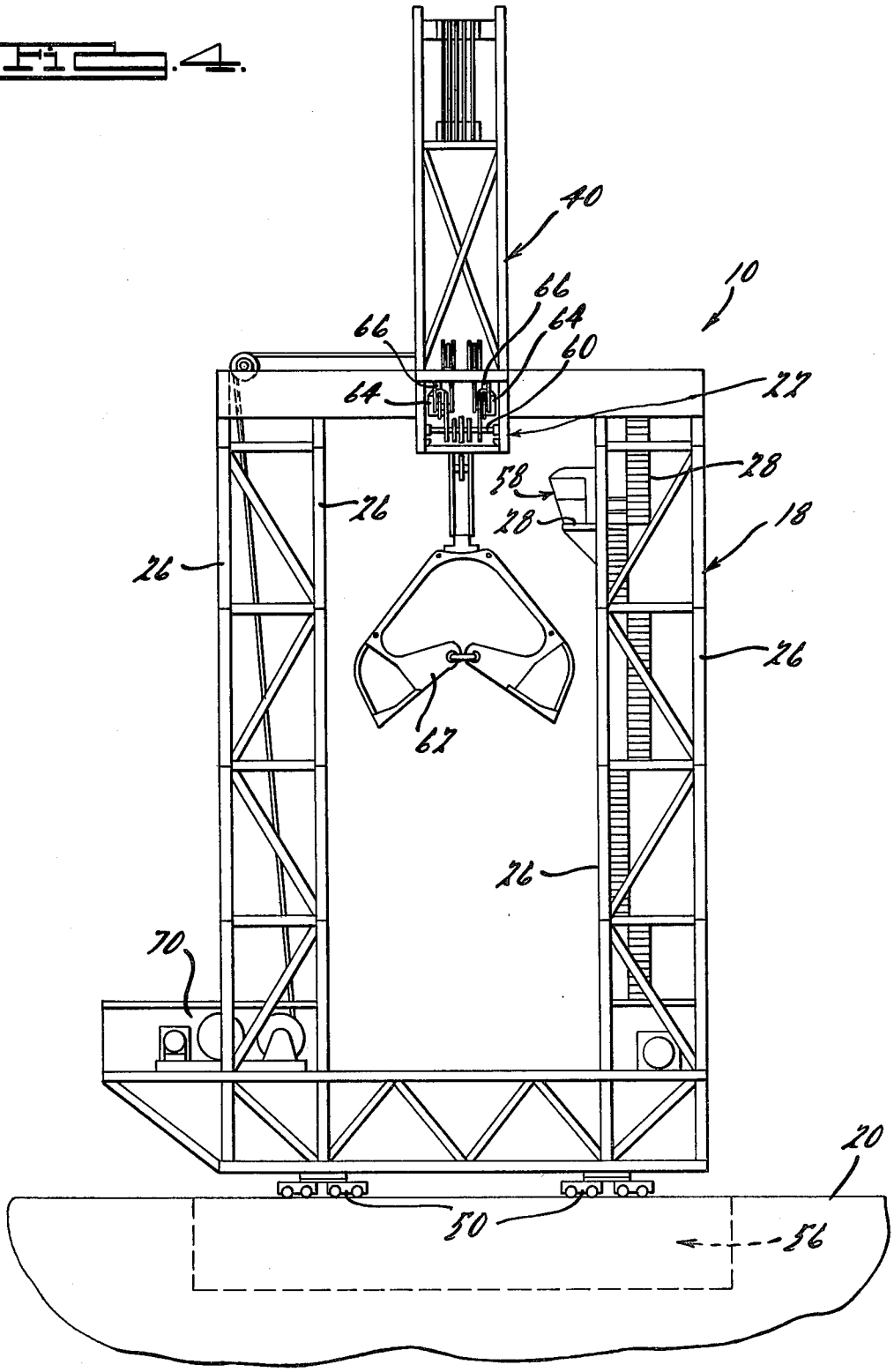
FIG. 4 is a side view of the crane structure of FIG. 1.

The tower structure 18 includes a number of upright support assemblies 26 interconnected by bracing cross-members 27 and personnel access ladders and platforms 28 as indicated generally in FIGS. 1 and 4. The boom portions 32 and 34 of the gantry structures 22 are pivotally secured to the upper end of the tower structure 18 and are supported in their horizontal operating positions by means of corresponding truss structures 36 and 38, respectively, which are supported by, and anchored to, a generally triangular upper A-frame support structure 40 by means of a pair of disconnectable link assemblies 44 and 46, respectively. The function of the pivotal connections on the boom portions 32 and 34 and on the link assemblies 44 and 46, is described in detail below.

The lower ends of the column assemblies 26 are secured to movable trucks 50 positioned on a pair of elongated rails 51, thereby allowing the crane structure 10 to travel along the deck of the floating barge 20. The mobility of the crane 10 provides the ability to load or unload several hatches of the cargo ship 12 without the necessity of moving or adjusting the position of the floating barge 20.

The trucks 50 are of any suitable type known to those skilled in the art and therefore are not shown in detail in the drawings. Preferably, however, the trucks 50 are hydraulic or electric powered and are equipped with equalized driving wheels such that the trucks 50 are capable of travelling under any anticipated trim or balance conditions of the floating barge 20.

Figure 2:
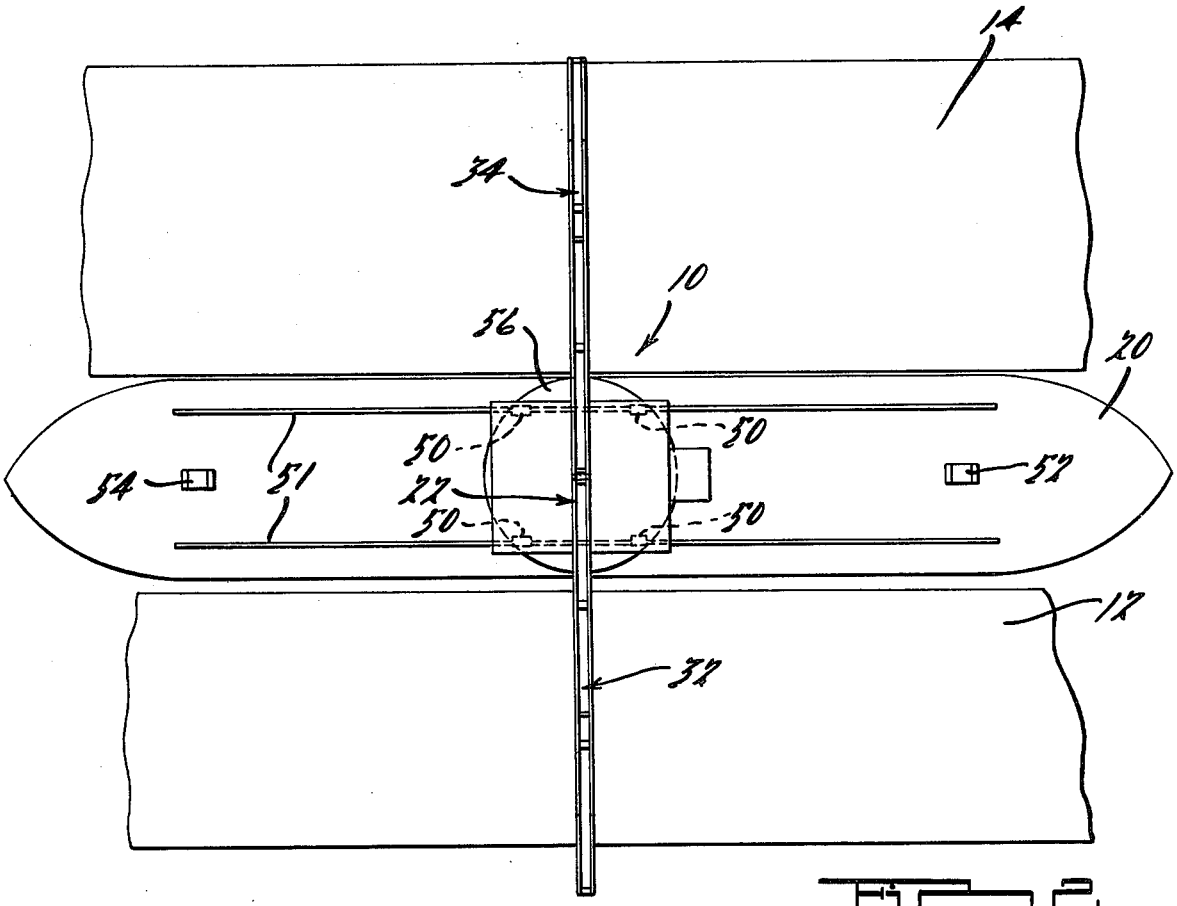
FIG. 2 is a top view of the crane of FIG. 1 with the horizontal boom portions of the crane structure shown in their operational positions.
Figure 3:
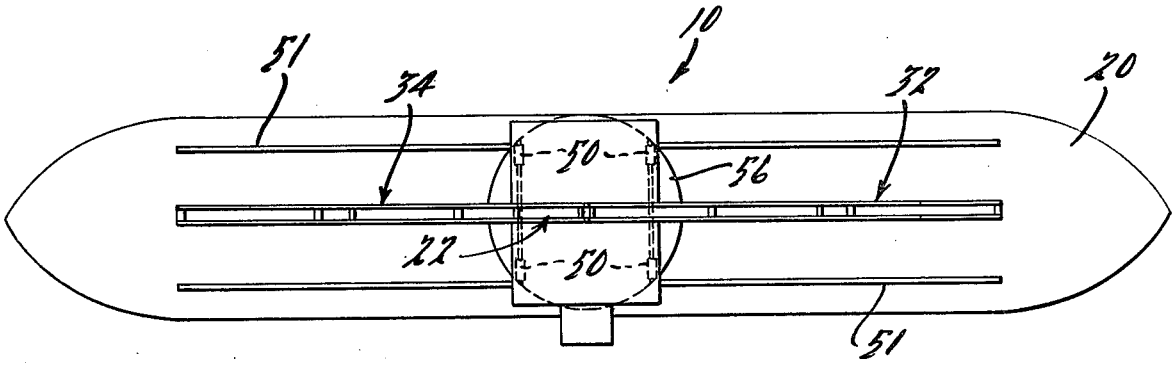
FIG. 3 is a top view similar to that of FIG. 2 but illustrating the boom portions of the crane structure rotated to their rest or transport positions.

In addition to being linearly mobile during use for purposes of loading or unloading several hatches of a large ship, the tower structure 18 is also rotatable as described below in order to move the boom portions 32 and 34 to the preferred rest positions on a pair of pedestals 52 and 54, respectively, thus allowing the floating barge 20 to be transported through narrow waterways. In FIG. 2, the crane 10 is shown with the tower structure 18 in its operating position with the boom portions 32 and 34 of the gantry structure 22 perpendicular to the direction of travel of the floating barge 20. In such a position, the crane 10 may be positioned for loading or unloading cargo by positioning the floating barge 20 between and adjacent the ship 12 and the cargo barge 14 as shown in FIG. 1. In FIG. 3, however, the tower structure 18 has been rotated 90° from the position of FIG. 2 by means of a turntable 56 such that the boom portions 32 and 34 of the gantry structure 22 are generally aligned with the direction of travel of the floating barge 20. The turntable 56 is similar to that used in railroad station roundhouses, which is well-known to those skilled in the art. The turntable 56 may be electrically powered, hydraulically powered, or driven by an engine. Preferably, the turntable 56 is actuated from an operator cab 58 that is self-contained within the tower structure 18 (see FIG. 4).

As will be further explained in detail below, the boom portions 32 and 34 are shown lowered in FIG. 3 to their rest positions on their corresponding pedestals 52 and 54, respectively. With the boom portions 32 and 34 in such rest positions, the upper A-frame structure 40 may be collapsed, as is also explained in detail below. The overall height and width of the crane structure 10 may thus be minimized in order to allow the floating barge 20 to travel from one location to another without interfering with bridges or narrow waterway passages.

As is perhaps best seen in FIGS. 4 through 6, the gantry structure 22 is equipped with a load trolley 60 having a bucket or other load-lifting apparatus 62. The load trolley 60 is supported for movement across the full length of the gantry structure 22 on a set of load trolley tracks 63 and is connected by trolley cables to a pair of counterweights 64 supported for movement by a pair of counterweight trolleys 66 over the full length of gantry 22 on separate sets of counterweight trolley tracks 67. The counterweights 64 and the load trolley 60 are interconnected or slaved together by means of such trolley cables extending over a series of pulleys or sheaves fixed to common axles such that any movement of the load trolley 60 along the gantry structure 22 results in an equal and opposite movement of the counterweights 64, thereby helping to counterbalance the loads on the boom portions 32 and 34. The load trolley 60 and the counterweight trolleys 66 are actuated together by a trolley winch 68 which drives a cable reel 69. The cable reel 69 pays out or takes up the trolley cables in order to move the load trolley 60 and the counterweight trolleys 66 in a coordinated, balanced manner.

The two counterweights 64 are designed to move together, effectively acting as one mass structure. Because the counterweights 64 are of a fixed mass, which does not vary with the weight of the load being carried, the counterweights will not maintain a perfect balance between the boom portions 32 and 34 in all cases. Their combined weight is, however, sufficient to maintain any imbalance between the loads on the boom portions 32 and 34 within acceptable operating limits. Furthermore, the gantry structure 22 and the tower structure 18 are designed to accommodate unbalanced loads within such limits. The provision of the dual counterweights 64, with one counterweight trolley 66 being located on each side of the centerline of the track for the load trolley 60, allows both the counter weight trolleys 66 and the load trolley 60 to travel in either direction across the full width of the boom portions 32 and 34 of the gantry structure 22. The bucket 62 is operated by means of a series of cables and pulleys or sheaves which are connected to a bucket winch 70, as is perhaps best seen in FIGS. 1 and 4.

The boom portions 32 and 34 of the gantry structure 22 are pivotally connected to the tower structure 18 by means of dual pivoting joint assemblies 82 and 84, respectively. Each of the joint assemblies 82 and 84 includes an upper boom hinge pin 86 and a lower boom hinge pin 88. When the boom portions 32 and 34 of the gantry structure 22 are in their normal operating positions, the upper boom hinge pins 86 are in their supporting positions in the joint assemblies 82 and 84, respectively. However, as will become apparent from the description in connection with FIGS. 7 through 13, when the lower boom hinge pins 88 are removed from the joint assemblies 82 and 84, the boom portions 32 and 34 respectively, may be pivoted upwardly. In contrast, when only the upper boom hinge pins 86 are removed from the joint assemblies 82 and 84, the boom portions may be pivotally lowered to their rest positions on the pedestals 52 and 54. Such pivotal raising and lowering operations of the boom portions 32 and 34 are preferably performed after the gantry structure 22 has been rotated to a position parallel to the direction of travel of the floating barge 20 as is shown in FIG. 3.

The raising and lowering of the boom portions 32 and 34 is accomplished by means of a pair of boom winches 92 and 94, respectively, which are operatively connected to corresponding cables 96 which extend upwardly over a set of pulleys or sheaves 98 on the A-frame structure 40 and are anchored to the truss structures 36 and 38 at anchor points 102 and 104, respectively. When the lower boom hinge pins 88 of the joint assemblies 82 and 84 are removed as is discussed below and the cables 96 are taken up by the boom winches 92 and 94, the truss structures 36 and 38 and, correspondingly, the boom portions 32 and 34 may be raised. In contrast, when the upper boom hinge pins 86 are removed and the lower hinge pins 88 are left in place, the boom winches 92 and 94 can be used to pay out portions of the cables 96, so that the truss structures 36 and 38 and, correspondingly, the boom portions 32 and 34 may be lowered below horizontal.

Figure 7:
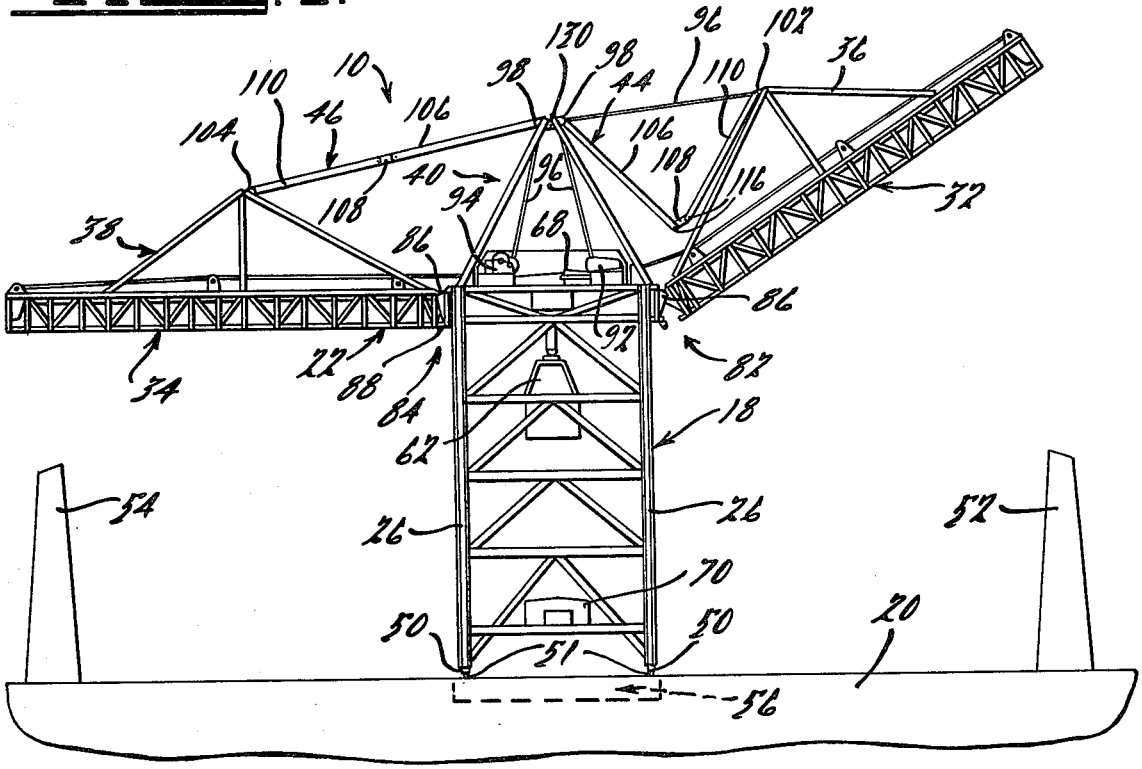
FIG. 7 is an elevation view similar to that of FIG. 1, but with one boom portion raised in preparation for being lowered to its rest position.
Figure 8:
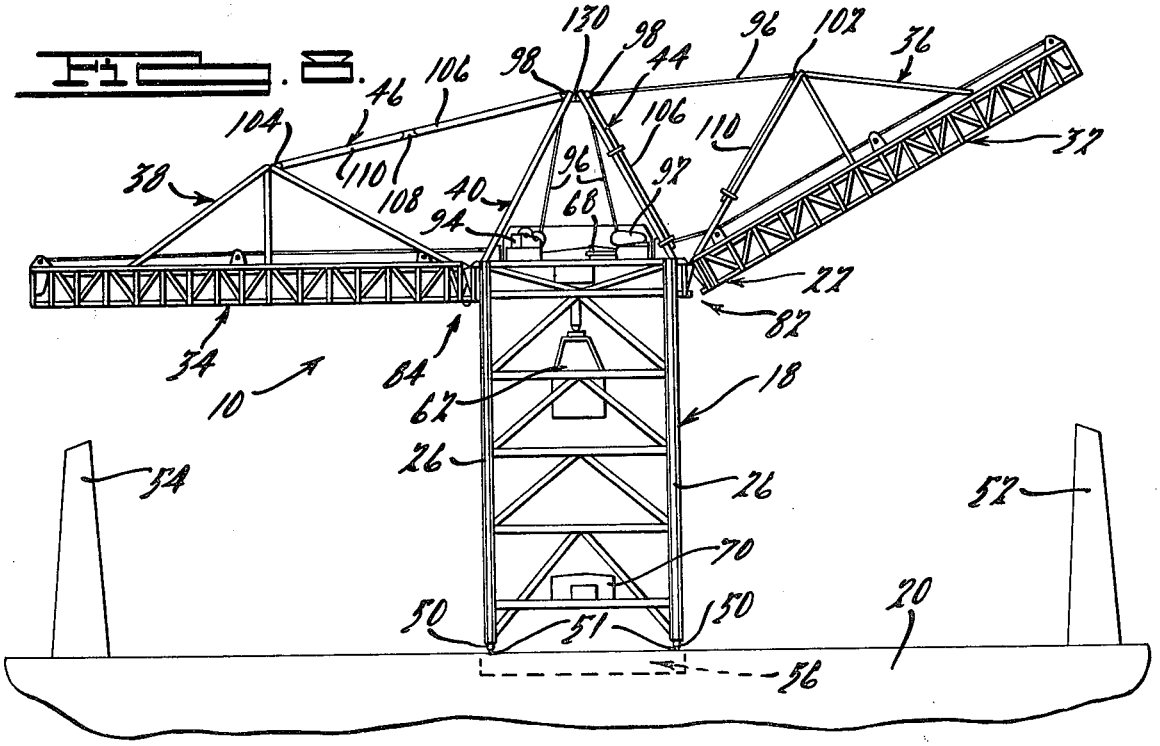
FIG. 8 is an elevation view similar to that of FIG. 7, illustrating further steps in the procedure used to lower the boom portion to its rest position.

FIGS. 7 and 8 illustrate the boom portions 32 in its raised position. Although FIGS. 7 and 8 and the related discussion herein relate to boom portion 32, it will become readily apparent that boom portion 34 functions in the same manner as that illustrated and described herein for boom portion 32. It should be noted that the raising of the boom portions 32 and 34 is a necessary preparatory step for the lowering of the boom portions 32 and 34 to their rest positions on pedestals 54 as will be explained in detail below in connection with the operation of the crane structure 10.

As described above, the truss structure 36 and, consequently, the boom portion 32 are anchored in their horizontal operating positions by means of the link assembly 44. The link assembly 44 includes an inner link member 106, an intermediate link member 108, and an outer link member 110. The inner link member 106 is pivotally connected to the upper A-frame structure 40 by means of an inner hinge pin 112. Similarly, the outer link member 110 is pivotally connected to the portion of the truss structure 36 by means of an outer hinge pin 114. The inner and outer link members 106 and 110 are also interconnected in a pivotal manner with intermediate hinge pins 116 to the intermediate link member 108. By such a linkage-type construction, the link assembly 44 is allowed to collapse as the boom winch 92 takes up a portion of the cable 96 and raises the truss structure 36 and the boom portion 32 to the raised position illustrated in FIG. 7.

Once the boom portion 32 is raised to its maximum elevation, one of the intermediate hinge pins 116 is removed from the pivotal connection with either the inner or the outer link member 106 or 110. The removal of either one of the intermediate hinge pins 116 disconnects the entire linkage assembly and thereby allows the boom portion 32 to be lowered below horizontal to its rest position on the pedestal 52. Such lowering of the boom portion 32 is accomplished by activating the boom winch 92 so as to pay out a portion of the cable 96.

Prior to the lowering of the boom portion 32, the inner and outer link members 106 and 110 should preferably be restrained by securing them to the A-frame structure 40 and the truss structure 36, respectively, as is shown in FIG. 8. Such restraining or tying-down of the link members 106 and 110 prevents them from being damaged during the lowering of the boom portion 32. The inner and outer link members 106 and 110 may be tied down or restrained by means of any of several restraining devices or methods known to those skilled in the art. For example, the link members may be anchored by means of chains or cables attached to the corresponding portions of the A-frame structure 40 and the truss structure 36. Alternatively, other releaseable clip or locking member devices known in the art may be employed.

Figure 9:
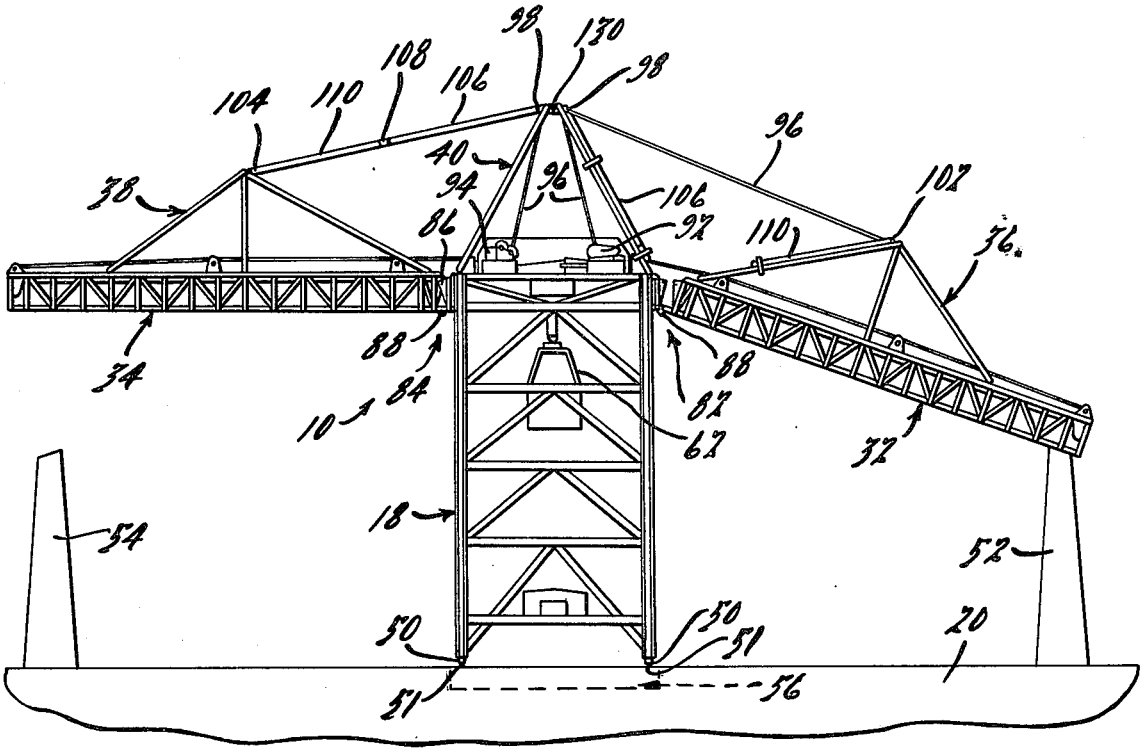
FIG. 9 is an elevation view of the crane structure of the present invention, illustrating one of the boom portions of the gantry structure lowered onto its rest pedestal.
Figure 10:
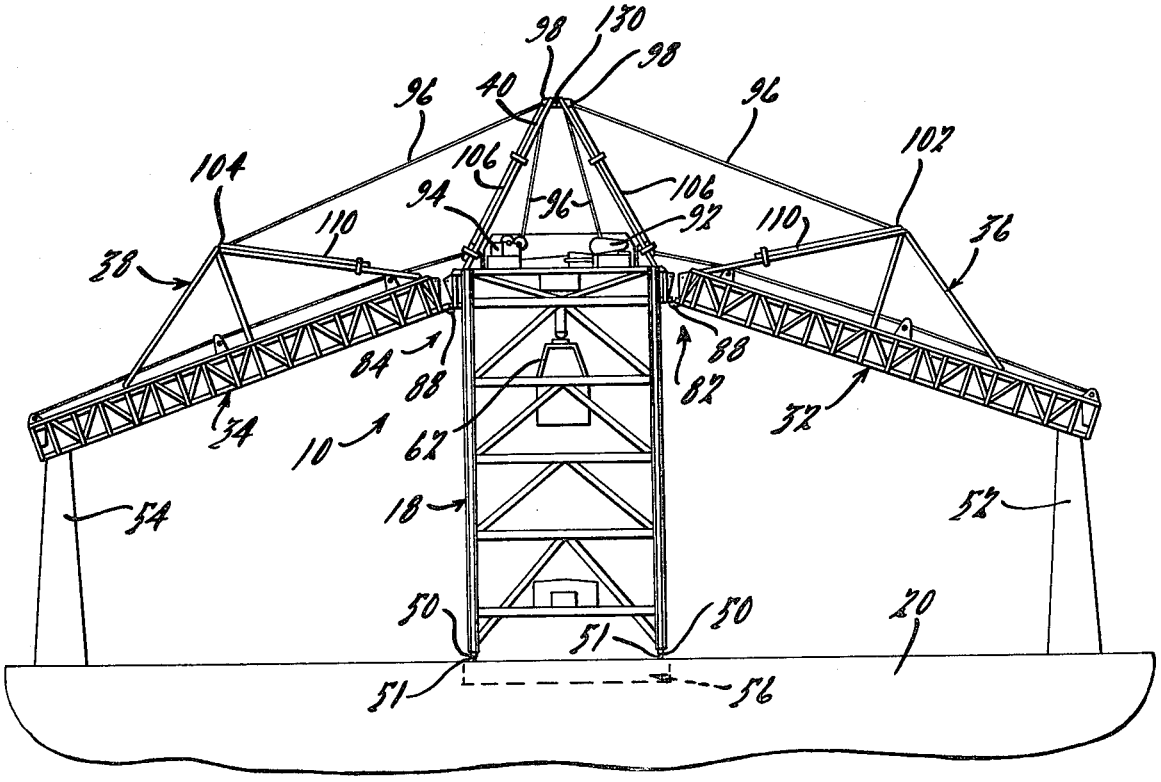
FIG. 10 is an elevation view similar to that of FIG. 9, but with both boom portions lowered onto their respective rest pedestals to prepare the crane for transport.

Once the link assembly 44 has been disconnected as described above, and the inner and outer link members 106 and 110 have been restrained to the A-frame structure 40 and the truss structure 36, respectively, the boom portion 32 is then lowered to horizontal, the upper boom hinge pins 86 are removed, and the lower boom hinge pins 88 are inserted, then the boom portion 32 is lowered to its rest position as shown in FIGS. 9 and 10. In a similar manner, the link assembly 46 is disconnected and restrained, and the boom portion 34 is lowered to its rest position on the pedestal 54.

FIGS. 9 and 10 illustrate the crane structure 10 with the boom portions 32 and 34, respectively, of the gantry structure 22 lowered to their rest positions on the rest pedestals 52 and 54, respectively. It should be noted that it is important to keep the cables 96 taut as they are paid out by the boom winches 92 and 94. By maintaining the cables 96 in a taut state, the boom portions 32 and 34 may be gently lowered to their rest positions on pedestals 52 and 54, respectively, without damage to the boom portions, the pedestals, or the floating barge 20. Once both boom portions 32 and 34 have been lowered to their rest positions as shown in FIG. 10, the overall height of the crane 10 is further reduced by lowering the A-frame structure 40 as described below.

As best shown by FIG. 1 and FIGS. 11 through 13, the right and left segments of the A-frame structure 40 are pivotally connected to the tower structure 18 by means of anchor pins 126 at their lower ends and interconnected at their upper ends by A-frame pin 130. A pair of hydraulic actuators 132 are pivotally interconnected with their respective segments of the A-frame structure 40 by means of inner and outer pivot pins 134 and 136, respectively, and are used for raising or lowering the A-frame segments only. The hydraulic actuators 132 are preferably the type of piston-and-cylinder devices well-kwown to those skilled in the art, which function in connection with a hydraulic fluid system as either hydraulic actuators or hydraulic dampers.

Figure 12:
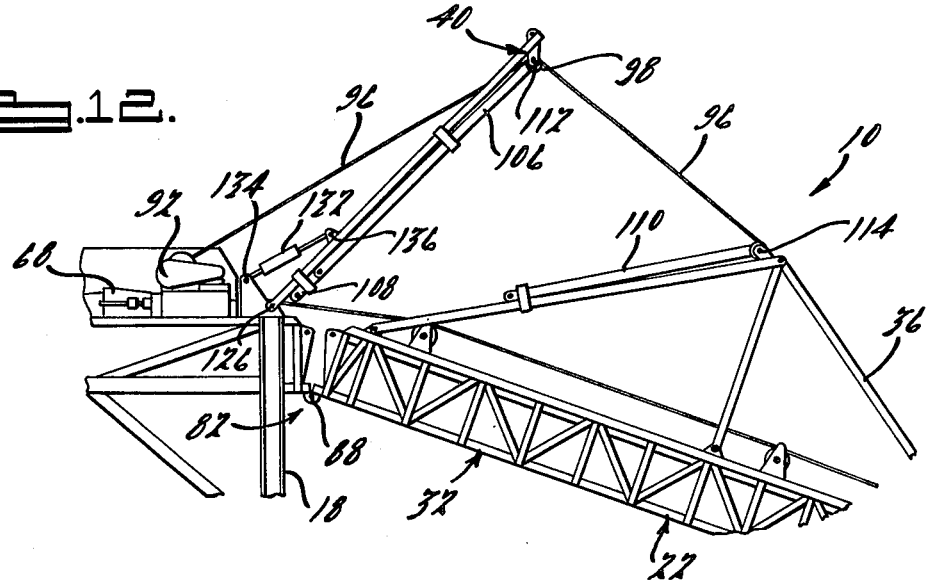
Figure 13:
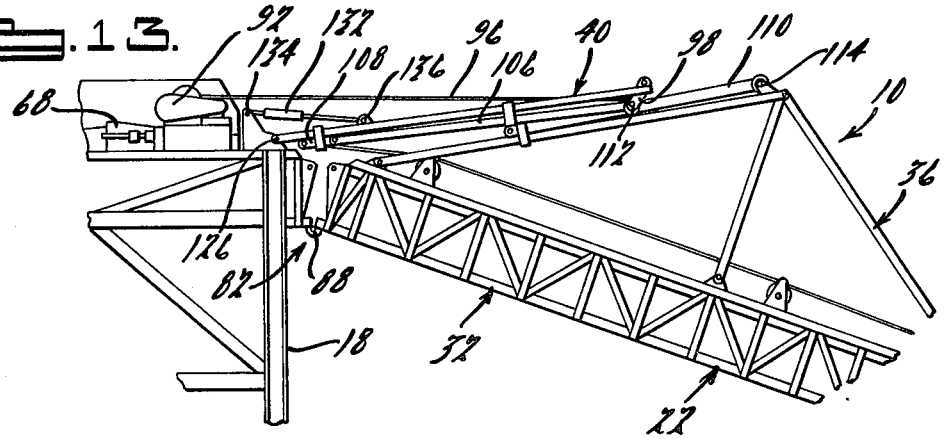

Once the boom portions 32 and 34 have been lowered to their rest positions on the pedestals 52 and 54, respectively, the A-frame pin 130 is removed from its inner connecting relationship with the right and left segments of the A-frame structure 40. The A-frame structure segments are then lowered to their rest positions adjacent the truss structures 36 and 38, as is illustrated in connection with one of the A-frame segments in FIGS. 11 through 13. Although the lowering of only the right-hand segment of the A-frame structure 40 is shown in FIGS. 11 through 13, it will become readily apparent from the following discussion that the lowering of the left-hand segment is accomplished in the same manner.

Figure 11:
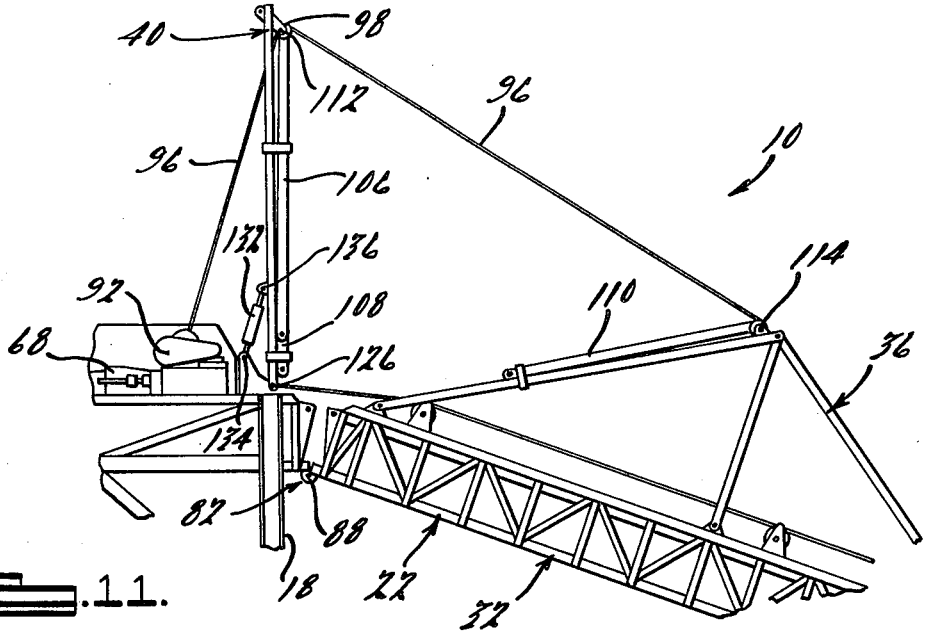
FIGS. 11 through 13 are partial elevation views of the crane structure of the present invention (with the boom portions lowered onto their respective pedestals) illustrating the mechanism and procedure for disassembling and lowering the upper A-frame supporting structure of the tower structure.

After the A-frame pin 130 has been removed from the A-frame structure 40, the boom hoist 92 is used to cause the A-frame structure segment to pivot outwardly toward a vertical position as shown in FIG. 11. Once the A-frame structure segment has been pivoted beyond such vertical position, it is allowed to continue to pivot and fall by gravity. The hydraulic actuator 132 then functions as a hydraulic damper to gently lower the A-frame structure segment to its rest position in contact with the truss structure 36 as shown in FIG. 13. The hydraulic damping provided by the hydraulic actuators 132 prevents damage to the A-frame structure segments and to the truss structures 36 and 38 as the A-frame structure 40 is collapsed.

After both the right and left segments of the A-frame structure 40 have been lowered to their rest positions as described above, the overall height of the crane 10 has thus been minimized, allowing the floating barge 20 to transport the crane beneath bridges or other overhead obstructions. Furthermore, by the rotation of the gantry structure 22 to a position parallel to the direction of travel of the floating barge 20, the overall width of the crane structure 10 has also been minimized. This allows the floating barge 20 to be transported through narrow waterway passageways.

The operation of the crane structure 10 may be summarized as follows. In order to lower the boom portions 32 and 34, one of the boom portions is first raised to its maximum elevated position. One of the intermediate hinge pins 116 is then removed in order to disconnect the corresponding link assembly 44 or 46. The inner and outer link members 106 and 110 are then tied down or restrained to the A-frame structure 40 and the truss structure 36 or 38, respectively. The boom winch 92 or 94 is then activated to pay out a portion of the cable 96 in order to lower the boom portion 32 or 34 to its horizontal position.

The lower boom hinge pin 88 is then inserted in the joint assembly 82 or 84 and the upper boom hinge pin is removed therefrom, thus allowing the boom winch 92 or 94 to continue lowering the boom portion 32 or 34 to its rest position on pedestal 52 or 54, respectively. During the lowering of the boom portions 32 or 34, the cable 96 should be kept taut in order to prevent damage to the boom portions, the rest pedestals, or the floating barge 20. The above operations are then repeated for the opposite boom portion, thereby positioning both of the boom portions 32 and 34 on the pedestals 52 and 54, respectively.

In order to collapse and lower the portions of the A-frame structure 40, the A-frame pin 130 is removed in order to free the right-hand and left-hand A-frame segments for pivotal rotation relative to the tower structure 18. The boom hoists 92 are used to rotate the A-frame segments beyond their vertical position where they will then continue to pivot and fall by gravity. The damping action of the hydraulic actuators 132 allow the A-frame segments to gently lower to their rest positions adjacent the truss structures 36 and 38 without damage. The boom winches 92 and 94 should be operated simultaneously with the lowering of the A-frame segments in order to take up the cables 96, thus preventing them from becoming entangled with other portions of the crane structure 10.

The raising of the boom portions 32 and 34 and the A-frame structure 40 is generally similar to that described above for the lowering of such members except that the above-described steps are performed in reverse order. In such a case, however, the hydraulic actuators 132 are operated to raise the A-frame segments beyond their vertical positions to a point where they will pivot toward each other under the influence of gravity. At such a point, the hydraulic actuators 132 again function as hydraulic dampers to prevent damage to the A-frame structure 40. The final positioning of the A-frame structure segments with respect to each other may be accomplished by operation of the boom winches 92 and 94 until the upper ends of the A-frame segments are properly aligned for reinsertion of the A-frame pin 130.

The boom portions 32 and 34 are then raised to their horizontal positions where the upper boom hinge pins 86 are reinserted and the lower boom hinge pins are removed, thereby allowing the boom portions 32 and 34 to be further raised to their maximum elevated positions as described above. Next, the inner and outer link members 106 and 110 are released from their restrained positions and reconnected by replacing the intermediate hinge pins 116. The boom portions 32 and 34 may then finally be lowered back to their horizontal operating positions. It is important to note that the boom winches 92 and 94 and the cables 96 are intended to be used only for raising and lowering the boom portions 32 and 34. The link assemblies 44 and 46 provide the support necessary for the boom portions to suspend the loads imposed on them during service.

As the foregoing discussion and the accompanying drawings disclose, illustrate and describe merely exemplary methods and embodiments according to the invention. One skilled in the art will readily recognize from such discussion and drawings that various changes, modifications and variations may be made therein without departing from the spirit and scope of the invention as defined in the following claims.

What is claimed is:

1. In an apparatus including a transport vehicle and a crane structure mounted on said transport vehicle, said crane structure including a gantry structure and a generally vertical tower structure, said gantry structure including two boom portions and trolley tracks thereon, said boom portions further being pivotally attached to and supported by said generally vertical tower structure and extending outwardly therefrom in opposite directions and selectively alignable with said trolley tracks, substantially at an upper end thereof, and said crane structure further including an upper supporting structure attached to said generally vertical tower structure substantially at said upper end thereof and protruding generally upwardly relative to said tower structure and said boom portions, the improvement comprising pivot means for selectively pivoting said boom portions relative to said vertical tower structure between respective operating positions wherein said boom portions protrude generally horizontally from said vertical tower structure substantially at said upper end thereof and respective rest positions wherein said boom portions are lower than the top of said vertical tower structure, at least one link assembly distinct from said pivot means disconnectibly interconnecting each of said boom portions with said upper supporting structure for supporting said boom portions in said respective operating positions, said link assemblies each including a number of link members disconnectibly connected to one another, at least a pair of adjacent link members in each of said link assemblies being selectively disconnectible from one another in order to disconnect said boom portions from said upper supporting structures and to allow said pivoting of said boom portions to said respective rest positions lower than the top of said vertical tower structure, power means for pivoting said boom portions including actuators means selectively interconnecting said upper supporting structure and said tower structure for selectively collapsing said upper support structure in order to selectively reduce the overall height of said crane structure to allow said transport vehicle to pass under overhead obstructions, said upper support structure including an A-frame structure pivotally and collapsibly attached to the top of said vertical tower structure said A-frame structure being collapsible when said boom portions are in said respective rest positions, said pivot means including upper and lower hinge assemblies pivotally and selectively disconnectibly interconnecting each of said boom portions with said vertical tower structure, and separate upper and lower means for selectively disconnecting each of said upper and lower hinge assemblies, respectively, said upper hinge assemblies pivotally interconnecting said boom portions to said vertical tower structure for upward pivotal movement from said respective operating positions and relative to said vertical tower structure when said lower hinge assemblies are disconnected, and said lower hinge assembly pivotaly interconnecting said boom portions to said vertical tower structure for downward pivotal movement from said respective operating positions and relative to said vertical tower structure when said lower hinge assemblies are disconnected, said link members being disconnectible from one another when the respective boom portions are pivotally moved upwardly relative to said vertical tower structure.

2. The apparatus according to claim 1, further comprising a load trolley with load-lifting means movably disposed on said trolley tracks, said boom portions being generally aligned with one another when in their respective operating positions in order to provide a generally continuous trolley tracks for said load trolley to be selectively moved from one of said boom portions to the other.

* * * * *

UNITED STATES PATENT AND TRADEMARK OFFICE

CERTIFICATE OF CORRECTION

PATENT NO. : 4,480,757

DATED : November 6, 1984

INVENTOR(S) : Maynard A. Oustad

It is certified that error appears in the above-identified patent and that said Letters Patent is hereby corrected as shown below:

Col. 10, line 3 (Claim 1) "lower" should be —upper—.

Signed and Sealed this

*Fifth* Day of *November 1985*

[SEAL]

*Attest:*

*Attesting Officer*

DONALD J. QUIGG

*Commissioner of Patents and Trademarks*